US007448161B2

(12) United States Patent
Taylor

(10) Patent No.: US 7,448,161 B2
(45) Date of Patent: Nov. 11, 2008

(54) DEVICE FOR SUPPORTING A PLANT ON A GRAVESITE MEMORIAL

(76) Inventor: Detlef Taylor, 7912 Courtleigh Dr., Orlando, FL (US) 32835-5929

( * ) Notice: Subject to any disclaimer, the term of this patent is extended or adjusted under 35 U.S.C. 154(b) by 187 days.

(21) Appl. No.: 11/124,063

(22) Filed: May 6, 2005

(65) Prior Publication Data

US 2005/0246951 A1 Nov. 10, 2005

Related U.S. Application Data

(60) Provisional application No. 60/569,353, filed on May 7, 2004.

(51) Int. Cl.
*A47G 7/06* (2006.01)

(52) U.S. Cl. ..... 47/41.1

(58) Field of Classification Search ..... 47/41.01, 47/41.12, 41.13, 41.1, 41.15, 70; D11/143, D11/147; D99/19; 248/523, 309.1, 314, 248/311.2, 27.8; 428/19
See application file for complete search history.

(56) References Cited

U.S. PATENT DOCUMENTS 3,165,863 A * 1/1965 Duran ..... 47/47
4,200,964 A 5/1980 Freitag
4,227,325 A 10/1980 Whitford
4,285,149 A 8/1981 Berryhill
4,722,160 A 2/1988 Davis
D332,762 S 1/1993 McCafferty, Jr.
5,437,127 A 8/1995 Ha
D384,305 S * 9/1997 Cox ..... D11/153
5,845,436 A 12/1998 Nota
5,882,744 A * 3/1999 Worcester ..... 428/18
6,119,394 A 9/2000 Fowler
D476,131 S 6/2003 Barnes
6,895,713 B2 * 5/2005 Warren ..... 47/39

* cited by examiner

*Primary Examiner*—T. Nguyen
(74) *Attorney, Agent, or Firm*—Beusse Wolter Sanks Mora & Maire, P.A.; Cian C. O'Brien, Esq.; Robert L. Wolter, Esq.

(57) ABSTRACT

A device for supporting a plant or other items on a cemetery memorial having a vase secured thereon, the device including a staff inserted into the vase and the staff having an support member having a cross-sectional dimension that is slightly less than a diameter of the vase so an outer edge of the support member wedges against an inside surface of the vase supporting the staff in an upright position, and the staff having a hooked top end for attaching the plant and/or other item elevated above the memorial.

7 Claims, 4 Drawing Sheets

DEVICE FOR SUPPORTING A PLANT ON A GRAVESITE MEMORIAL

This application claims priority of Provisional Patent Application Ser. No. 60/569,353, filed on May 7, 2004.

BACKGROUND OF THE INVENTION

This invention relates in general to gravesite memorials and, more specifically, to those devices that support plants or other items on the memorials.

Oftentimes, visitors to a gravesite memorial have plants or novelty items that they would like to leave at the gravesite memorial. When a vase is part of the memorial some plants, such as a hanging plant, or novelty items do not fit within the vase. Accordingly, the visitors must place the item on the ground outside the borders of the memorial so as not to cover up names or any inscriptions on the memorial. This may violate certain rules of a cemetery and/or the items may obstruct cemetery ground maintenance.

BRIEF DESCRIPTION OF THE INVENTION

Towards this end, a device and system is disclosed for supporting plants or other items above a gravesite memorial. The device has a staff inserted into the vase. The staff has a support member having a cross-sectional dimension that is slightly less than a diameter of the vase so an outer edge of the support member wedges against an inside surface of the vase supporting the staff in an upright position. The staff further has a hooked top end for attaching the plant and/or other item elevated above the memorial.

A system for supporting a plant or other items on a cemetery memorial has a vase that is attachable to the memorial. A staff having a base inserted into the vase and having an element at a top end of the staff to support the plant or other items elevated above the memorial is also part of the system. The system also has a support member, connected to said staff at the base, having a cross-sectional dimension that is slightly less than a diameter of the vase so an outer edge of the support member wedges against an inside surface of the vase supporting the staff in an upright position.

BRIEF DESCRIPTION OF THE DRAWINGS

The figures shown depict only exemplary configurations that may be employed for the present invention. Those skilled in the art will recognize variations to the figures presented herein. The features and advantages of the present invention will become apparent from the following detailed description of the invention when read with the accompanying drawings in which.

DETAILED DESCRIPTION OF THE INVENTION

Figure 1:
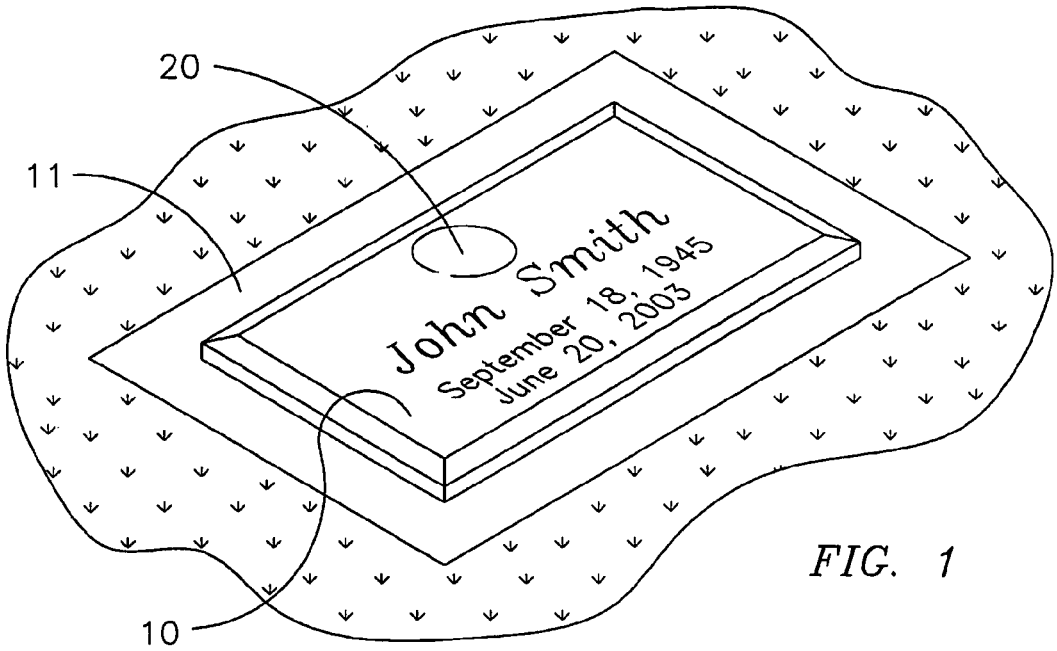
FIG. 1 is an exemplary embodiment of a gravesite memorial with a hole provided for a vase.

The invention is used in connection with gravesite memorials, as depicted in FIG. 1, which includes a foundation 11, upon which the memorial 10 is mounted. The foundations 11 are typically manufactured from a granite material and are placed in the ground, and the memorial 10 is usually a metal, such as bronze, upon which names, dates and/or messages may be engraved, embossed or affixed.

Figure 2A:
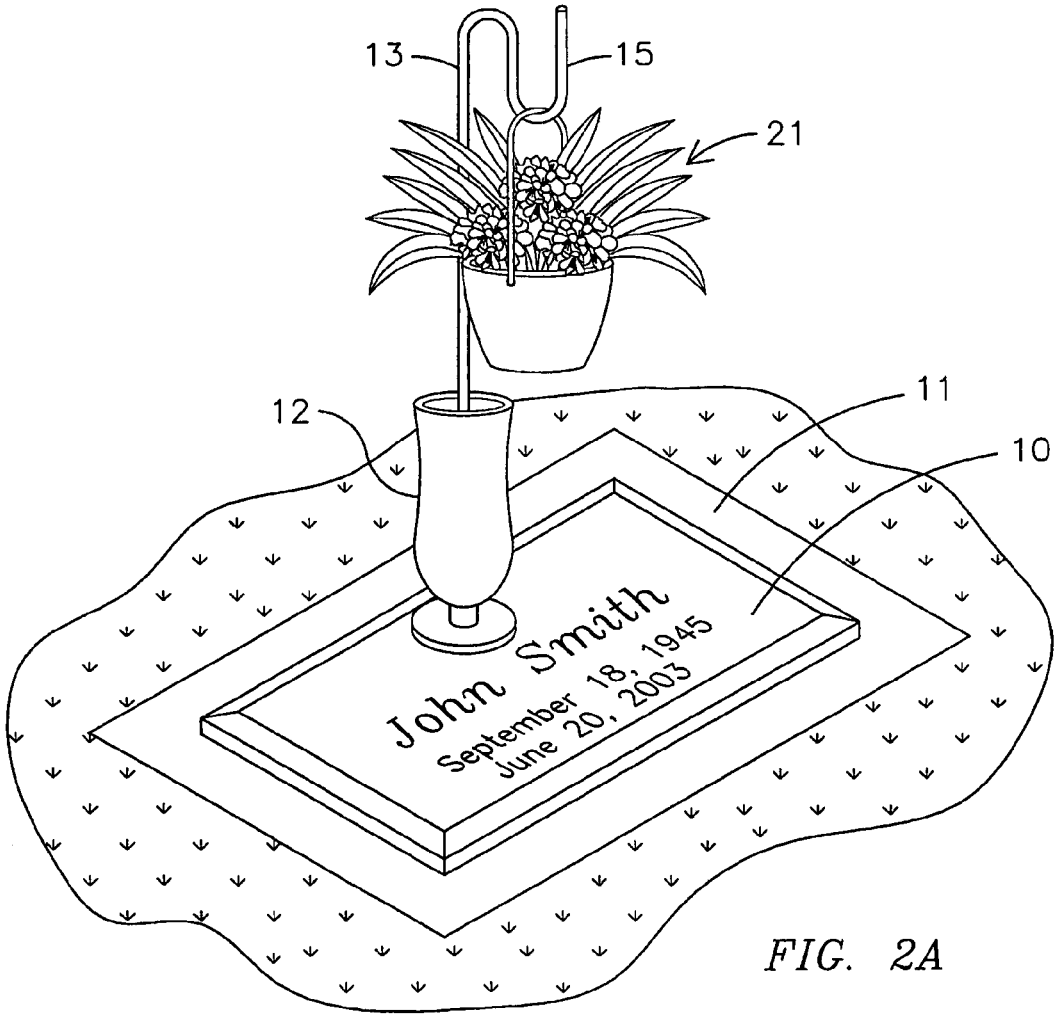
FIGS. 2A-2C are exemplary embodiments of a gravesite memorial with a vase and the present invention utilized wherein various upper end of a staff are illustrated.
Figure 2B:
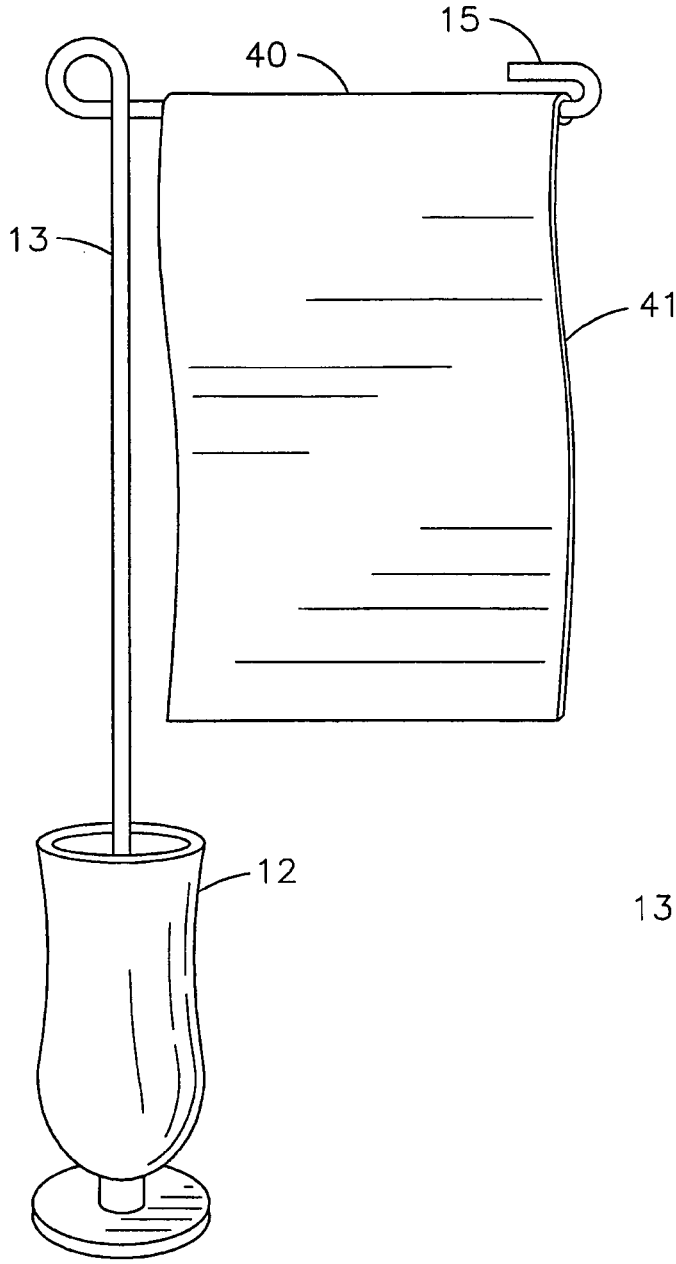
Figure 2C:
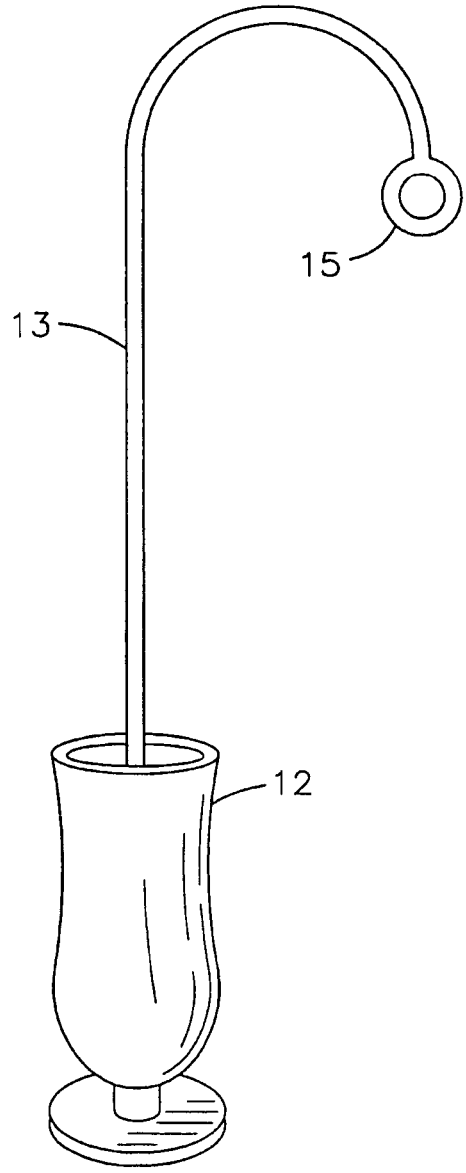
Figure 3:
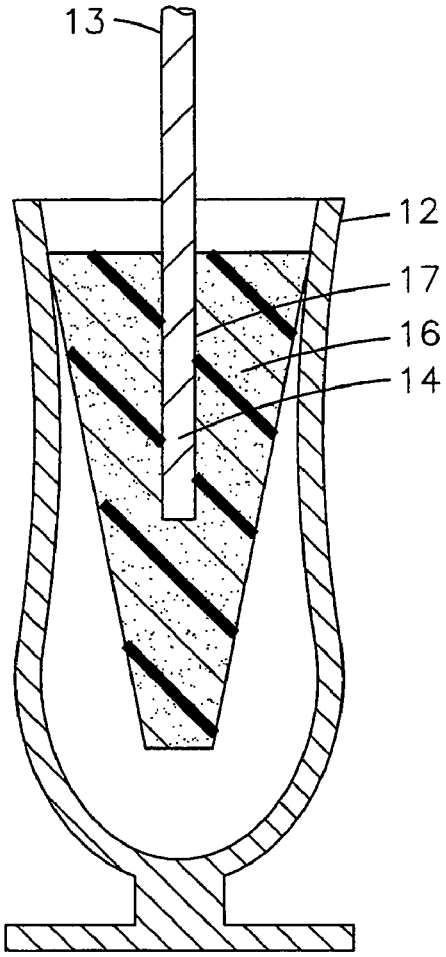
FIG. 3 is an exemplary embodiment of a vase with the present invention placed within it.

As further illustrated in FIGS. 2A-2C, a vase 12 is usually mounted to the memorial 10. Typically, when the vase 12 is not in use, it is inverted into a hole 20, so the bottom of the vase 12 is flush with the top of the memorial 10, as shown in FIG. 1. When the vase 12 is in use, it is removed from the hole 20 and placed upright, and the base of the vase 12 is secured to the memorial 10, as shown in FIGS. 2A-2C.

As illustrated in FIGS. 2A-4, the present invention and includes a staff 13 that supports plants or items, having a base 14 that is insertable within the vase 12 on a memorial 10 and supports the staff 13 in an upright position. The staff 13 usually includes a hooked end 15, upon which the novelty item 21 may be attached and suspended above the memorial 10. Those skilled in the art will readily recognize that other elements than a hooked end can be provided. For example, though not limited to this option, the staff may include a shelf (not illustrated) upon which a plant could sit. Other variations of the hook end or upper end of the staff are illustrated in FIGS. 2B & 2C. As illustrated, the upper end may have an attachment element 40 for holding a flag and/or banner 41. As illustrated in FIG. 2C the upper end of the staff 13 may be arcuate in shape, to provide a more aesthetically pleasing image, with a hook at the end of the staff.

The base 14 of the staff 13 includes a support member 16 which has an outside diameter that is slightly less than the inside diameter of the vase 12. Accordingly, when the base of the staff 13 with the support member 16 is placed within the vase 12, the support member 16 will wedge against the sides of the vase 12 and support the staff 13 in an upright position.

Figure 4:
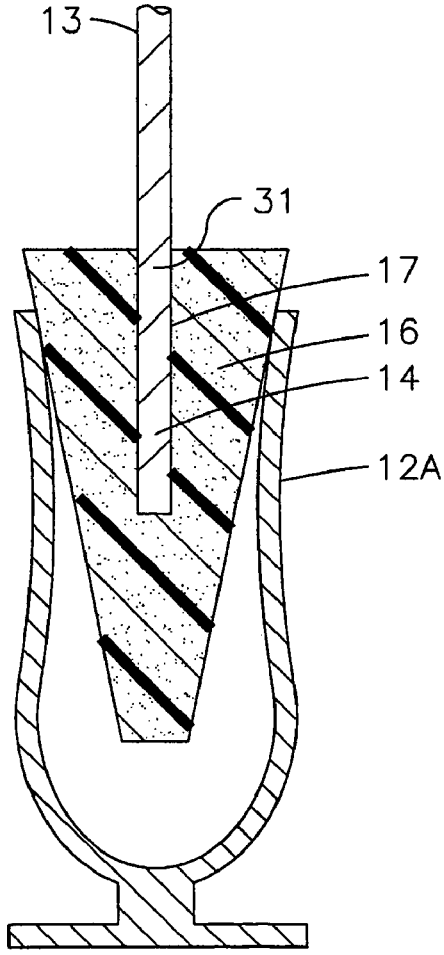
FIG. 4 is an exemplary embodiment of a vase with the present invention.

In a preferred embodiment, the support member 16 may include a wedge or cone-shaped member in which the staff 13 is inserted. The member 16 may be composed of a solid rubber that provides sufficient weight and support to the staff 13 to hold the plant or item upright. The cone-shape allows the member 16 to be used for different shaped or sized vases. As shown in FIG. 4, the staff 13 and member 16 are inserted into a vase 12A having a smaller diameter wherein the member 16 does not fit completely within the vase 12A.

The base 31 of the staff 13 may be fitted in a hole 17 in the support member 16. Alternatively, the base of the staff 13 and the hole 17 may be threaded to secure the staff 13 in the support member 16.

Figure 5A:
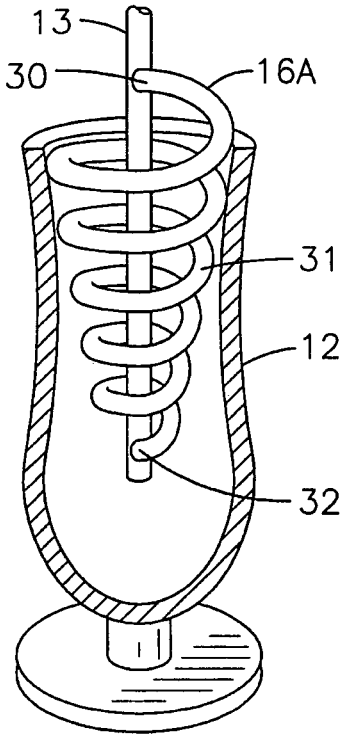
FIGS. 5A and 5B are exemplary embodiments of the present invention having a spiral wire as a support member.
Figure 5B:
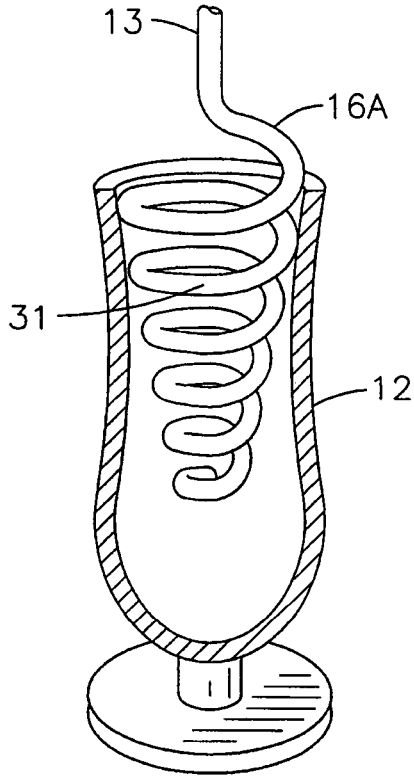
Figure 6:
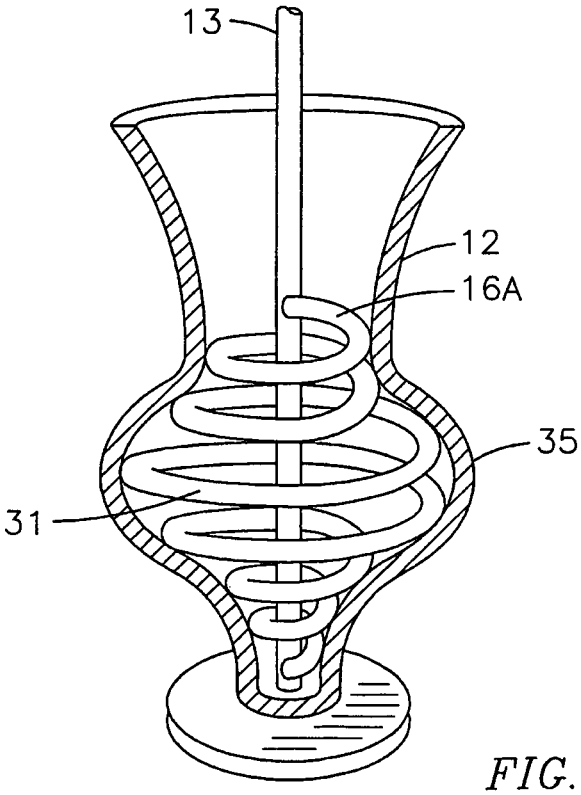
FIG. 6 is an exemplary embodiment of a wire support member configured for a particular part of a vase.

In another preferred embodiment, the support member 16A is a wired spiral element, as illustrated in FIGS. 5A, 5B & 6, which is connected to the staff. As illustrated in FIGS. 5A & 5B, the support member 16A has the same shape of the above-discussed support members 16, but is made of wire, such as but not limited to galvanized steel having a spiral configuration. In one embodiment, illustrated in FIG. 5A, this support member 16A is an extension of the staff 13. In other words, the base 31 of the staff 13 is formed in a spiral configuration. In another preferred embodiment, illustrated in FIG. 5B, the spiral support member 16A is attached to the staff 13 wherein the staff 13 may, or may not (not disclosed), extend through the support member 16A. As illustrated in FIG. 5B, the support member 16A is attached to the staff 13 at two locations 30, 32, wherein more or less attachment locations may be utilized.

As illustrated in FIG. 6, the support member 16A is formed in a configuration to contact the inside of a vase 12. As illustrated, the support member 16A has a bulb-like shape that fits within the base 35 of the vase 12. Those skilled in the art will readily recognize that the shape of this support member 16A can have a plurality of shapes based on the interior shape of the vase 12 that the support member is suppose to fit within. The support member can be made of a material that allows for it to be deformed should the support member have to pass through a diameter of the vase that is smaller than the diameter of the base of the base.

While the invention has been described in what is presently considered to be a preferred embodiment, many variations and modifications will become apparent to those skilled in the art. Accordingly, it is intended that the invention not be limited to the specific illustrative embodiment, but be interpreted within the full spirit and scope of the appended claims.

I claim as my invention:

1. A combination of a cemetery memorial and a device for supporting a plant or other items on the cemetery memorial, the combination comprising:

the cemetery memorial having a vase and a means for supporting the vase;

a staff inserted into the vase, said staff having a hooked top end for attaching the plant or other item elevated above the cemetery memorial; and a spiral-shaped support member having a continuously reducing diameter from a top portion to a base portion, wherein the spiral-shaped support member comprises a coil having a plurality of turns from the top portion to the base portion, said plurality of turns having said continuously reducing diameter from the top portion to the base portion, a respective spacing is provided between consecutive turns from the top portion to the base portion said staff being configured to pass through a central axis of said spiral-shaped support member extending from said top portion to said base portion, said spiral-shaped support member having a cross-sectional dimension that is slightly less than a diameter of the vase so an outer edge of the spiral-shaped support member wedges against an inside surface of the vase supporting the staff in an upright position, said base portion coupled to a bottom end of said staff within said vase, and said top portion coupled to a portion of said staff between said hooked top end and said bottom end.

2. The device of claim 1 wherein the support member is a cone-shaped member.

3. The device of claim 1 wherein the support member is water-resistant.

4. The device of claim 1 wherein the support member is composed of wire.

5. The device of claim 1 wherein the support member surrounds a base of the staff and is connected by at least two connection points to said staff.

6. The device of claim 1 wherein the support member is configured to have a shape of a base of the vase having a cross-sectional dimension that is slightly less than a diameter of the base of the vase so an outer edge of the support member wedges against an inside surface of the base of the vase supporting the staff in an upright position.

7. The device of claim 1 wherein said hook top end for attaching the plant or other item elevated above the memorial comprises a horizontal attachment element for attachment of a flag to hang vertically downward and elevated above the memorial.

* * * * *